US005819339A

United States Patent [19]

Hodgetts

[11] Patent Number: 5,819,339

[45] Date of Patent: Oct. 13, 1998

[54] PATIENT TRANSPORT SYSTEM

[75] Inventor: Graham L. Hodgetts, Baden, Pa.

[73] Assignee: Barton Medical Corporation, Austin, Tex.

[21] Appl. No.: 330,808

[22] Filed: Oct. 28, 1994

[51] Int. Cl.[6] ..... A61G 7/08

[52] U.S. Cl. ..... 5/88.1

[58] Field of Search ..... 5/88.1, 84.1, 89.1, 5/498, 496

[56] References Cited

U.S. PATENT DOCUMENTS

| | | | |
|---|---|---|---|
| 378,220 | 2/1888 | Staples et al. . | |
| 716,886 | 12/1902 | Goode . | |
| 1,263,611 | 4/1918 | Scroggin . | |
| 1,487,171 | 3/1924 | La Vigne . | |
| 2,093,231 | 9/1937 | Broadwell | 24/245 |
| 2,439,066 | 4/1948 | Vanderlyn | 5/88.1 |
| 2,536,707 | 1/1951 | Allyn | 5/85 |
| 2,630,583 | 3/1953 | Gilleland | 5/81 |
| 2,733,452 | 2/1956 | Tanney | 5/88.1 |
| 2,745,163 | 5/1956 | Van Buren, Jr. | 24/246 |
| 2,939,195 | 6/1960 | Carlson | 24/245 |
| 3,302,219 | 2/1967 | Harris | 5/85 |
| 3,413,663 | 12/1968 | Swann | 5/81 |
| 3,593,351 | 7/1971 | Dove | 5/81 |
| 3,709,556 | 1/1973 | Allard et al. | 297/188 |
| 3,769,642 | 11/1973 | Warman | 5/81 A |
| 3,794,313 | 2/1974 | Berger et al. | 269/322 |
| 3,810,263 | 5/1974 | Taylor et al. | 5/81 R |
| 3,924,281 | 12/1975 | Gibbs | 5/88.1 |
| 4,068,770 | 1/1978 | Boehringer | 214/85 |
| 4,270,234 | 6/1981 | James | 5/88.1 |
| 4,502,169 | 3/1985 | Persson | 5/88.1 |
| 4,660,240 | 4/1987 | Hutton | 5/498 |
| 4,686,748 | 8/1987 | Kaivanto | 24/522 |
| 4,688,304 | 8/1987 | Marcott | 24/459 |
| 4,696,025 | 9/1987 | Taylor | 378/146 |
| 4,747,170 | 5/1988 | Knouse | 5/81 |
| 4,761,841 | 8/1988 | Larsen | 5/81 R |
| 4,776,047 | 10/1988 | DiMatteo | 5/81 R |
| 4,782,543 | 11/1988 | Hutton | 5/498 |
| 4,787,104 | 11/1988 | Grantham | 5/66 |
| 4,837,872 | 6/1989 | DiMatteo | 5/88.1 |
| 4,868,938 | 9/1989 | Knouse | 5/88.1 |
| 4,947,418 | 8/1990 | Barr et al. | 378/177 |
| 4,970,738 | 11/1990 | Cole | 5/81.13 |
| 5,022,810 | 6/1991 | Sherrow et al. | 414/501 |
| 5,033,170 | 7/1991 | Ewert | 24/459 |
| 5,161,276 | 11/1992 | Hutton | 5/498 |
| 5,163,189 | 11/1992 | DeGray | 5/86.1 |
| 5,213,580 | 5/1993 | Slepian et al. | 623/1 |
| 5,236,390 | 8/1993 | Young | 454/95 |
| 5,279,010 | 1/1994 | Ferrand et al. | 5/600 |
| 5,340,266 | 8/1994 | Hodgetts | 414/527 |
| 5,544,371 | 8/1996 | Fuller | 5/88.1 |

FOREIGN PATENT DOCUMENTS

| | | | |
|---|---|---|---|
| 6818 | of 0000 | Australia | 5/88.1 |
| 26017 | 11/1907 | United Kingdom | 5/88.1 |
| 10012 | 4/1909 | United Kingdom | 5/88.1 |
| 00221 | 1/1986 | WIPO | 5/88.1 |

*Primary Examiner*—Michael J. Milano

*Attorney, Agent, or Firm*—Webb Ziesenheim Bruening Logsdon Orkin & Hanson, P.C.

[57] ABSTRACT

A patient transport system for transporting a patient that includes a base, a patient supporting member attached to the base, a conveyor attached to the base (such as a bed or a gurney) and a removable sheet (such as a bed sheet) having a first end and a second end, the sheet first end removably attached to the conveyor, the sheet second end being free, wherein the sheet is adapted to be positioned onto the patient supporting member. The patient transport system can be used to transport an immobile patient between a bed and a gurney or vice versa. The sheet is removably attached to the conveyor by adhesive tape or a clip arrangement. A flexible belt attaches the clip to the conveyor. The clip includes a body member having a recess with a plug received therein. Also disclosed are methods for moving a patient from a bed and from a gurney and a method for changing a sheet on the bed of an immobile patient.

5 Claims, 4 Drawing Sheets

PATIENT TRANSPORT SYSTEM

BACKGROUND OF THE INVENTION

1. Field of the Invention

This invention relates to patient transport systems, and more particularly, to a patient transport system for transferring an immobile patient from a gurney to a bed or vice versa.

2. Description of the Prior Art

It appears to be widely accepted that a major, if not the major, work related complaint among nurses and hospital nursing staff is back injuries caused by lifting patients and getting them in and out of a bed and to and from a gurney. A survey of existing practices and techniques suggests that there is not a widely adopted simple and safe method of transferring patients from a bed to a gurney, or vice versa, without lifting them. There are hoist type lifts where the patient is suspended in a sling. The sling must be first manipulated under the patient and then the patient must be physically lifted, changing the shape of the body and applying pressures different from those existing on the patient when laying prone in bed. There are also roller boards which are inserted partially under the patient and then the patient is pulled onto the roller board. Again, the patient must be manipulated to allow the board to be inserted and then the body is pulled onto the board; in the end, the patient ends up on the board, not on the gurney or bed. An additional disadvantage of the roller board is that either the patient must cooperate with the transferrer or more than one transferrer is required to effect the transfer. Patients have also been known to drop off the roller boards and to land on the floor between the bed and the gurney.

Also, previous inventions make use of conveyors external to both the bed and the gurney in which the patient is passed from one to the other which results in unnecessary and complex devices. Such devices are set forth in U.S. Pat. Nos. 5,163,189; 4,776,047; 4,761,841; 3,810,263; 3,769,642; 3,593,351; 3,413,663; 3,302,219; 2,733,452; 2,630,583; 2,536,707; 1,487,171; 1,263,611; 716,886; and 378,220.

Therefore, it is an object of our invention to allow a patient, while lying in the prone position and completely immobile, to be moved by one person of relatively low strength smoothly and safely from a bed onto a gurney and vice versa.

It is also an object of our invention to provide an inexpensive apparatus to transfer the patient from a bed to a gurney and vice versa.

SUMMARY OF THE INVENTION

Our invention is an apparatus for transporting a patient having a base, a patient supporting member attached to the base, a conveyor attached to the base and a removable sheet. The sheet has a first end and a second end where the sheet first end is removably attached to the conveyor and the sheet second end is free. The sheet is adapted to be positioned on the patient supporting member. The conveyor can be used in combination with a bed and a gurney for transporting a patient from the bed to the gurney or the gurney to the bed. The patient supporting member can be a mattress. The base can be a bed frame or a gurney frame, and the patient supporting member extends in a first longitudinal direction and the conveyor moves the sheet in a second longitudinal direction, which is transverse to the first longitudinal direction.

The conveyor includes a roller and attaching member coupled to the roller and the base, and a rotating member, such as a handle, attached to the base. The roller has a first end and a second end and a length substantially equal to a length of the base. The sheet is flexible having an underside adapted to slide along the surface of the patient supporting member. The sheet first end is removably attached to the roller. The rotating member is for rotating a roller about a longitudinal axis passing through the roller, whereby a patient positioned on the sheet extended across the patient supporting member can be moved toward the roller when the roller is rotated. Rotation of the roller causes the sheet to be wound onto the roller.

The attaching member includes an adjustable bracket having a first L-shaped member and a second member. The first L-shaped member includes a first leg and a second leg. The first leg is coupled to the roller and the second leg extends from the first leg. The second leg includes two spaced apart holes. The second member includes a U-shaped portion with two legs extending therefrom. A portion of each of the legs is threaded. The threaded portions pass through the respective holes defined in the second leg of the first L-shaped member. Threaded nuts are received by respective threaded portions of the legs and abut against the second leg. A recess is defined by the first L-shaped member and the second member which receives a portion of the base, whereby when the nuts are tightened against the second leg, the conveyor is held in place to the base by frictional forces between the first L-shaped member and the second member and the base. A bearing unit is attached to the L-shaped member and is rotatably attached or coupled to the first end of the roller.

The sheet can be a standard bed sheet made of fabric having at least 180 threads per inch. A receptacle can be attached to the base for receiving the free end of the sheet.

The sheet can be removably attached to the roller by adhesive tape or a fastener attached to the conveyor.

The sheet can be attached to the conveyor through a flexible belt having two ends, one belt end attached to the conveyor and the other belt end releasably attached to the sheet. The fastener can be attached to the other belt end, whereby the sheet is releasably attached to the belt through the fastener. The fastener can be a clip including a body defining a slot and a plug received in the slot. The plug is adapted to sandwich and bind a portion of the sheet between the plug and the body. The slot includes a converging portion defined by edges of the body. The edges of the body coact with the plug to releasably attach the sheet to the conveyor. The plug includes a first member attached to a second member and a third member attached to the second member, wherein the second member is positioned between a first member and a third member. The first member and third member having geometric diameters greater than the second member. A portion of each of the edges of the body sandwiched between the first and third members and the second member is positioned between the portions of the edges of the body. The sheet is sandwiched between the first member, the second member, the third member and the portions of the edges of the body. The edges of the body are adapted to compress the plug second member. Preferably, at least one of the first or third members of the plug can pass through the slot defined by the body. The second member of the plug is circular shaped and made of rubber.

Also disclosed is a method for transferring a patient to and from a bed having a mattress and a gurney having a patient supporting member where a conveyor is attached to one of the bed or gurney. The method includes the steps of placing a sheet on the mattress of the bed or the patient supporting member of the gurney; positioning the patient on the sheet; attaching the conveyor to the one of the bed and the gurney having the sheet; positioning the gurney adjacent to the bed so that the conveyor is along a side of the other of the gurney and the bed, the side being furthest away from the one of the bed and the gurney having the sheet; extending the sheet over the other of the bed and gurney, removably attaching the sheet to the roller; rotating the roller and thereby winding the sheet around the roller; and moving the patient on the sheet from one of the bed and the gurney onto the other of the bed and the gurney. The sheet is then removed from the roller after the patient is moved and secured to the bed. If the sheet is originally secured to the bed, i.e, tucked under the mattress, then initially the sheet is unsecured from the bed, i.e., untucked, and an end of the sheet is secured to the roller. Preferably, the bed and the gurney are adjusted so that an upper surface of the bed mattress is positioned above an upper surface of the patient supporting surface of the gurney prior to rotating the roller, thereby moving the patient onto the gurney.

When the patient is initially positioned on the gurney on a lateral centerline of the sheet and is then to be transported onto the bed, the method can further include extending a portion of the sheet across the bed after the gurney is positioned adjacent the bed and then attaching the end of the sheet to the roller; adjusting the bed and the gurney so that an upper surface of the bed mattress is positioned above an upper surface of the patient supporting member of the gurney and then rotating the roller; moving the patient onto the bed until the longitudinal centerline of the sheet corresponds to a centerline of the bed mattress; and removing the sheet from roller and securing the sheet to the bed.

Also, the conveyor, bed and gurney can be used for changing the sheet on the bed of an immobile patient, wherein a conveyor is attached to the bed and a conveyor is attached to the gurney. The method includes placing the patient on a sheet on the mattress; unsecuring the sheet from the bed; attaching an end of the sheet to the conveyor roller attached to the bed; moving the gurney so that a side of the gurney is adjacent the conveyor roller attached to the bed, wherein the roller attached to the gurney is positioned on an opposite side of the gurney and away from the roller attached to the bed; attaching an end of a clean sheet to the conveyor roller attached to the gurney; extending the clean sheet over the patient supporting surface of the gurney; rotating the bed conveyor roller so as to move the patient toward the roller; rotating the gurney conveyor roller when the patient contacts the gurney moving the patient toward the gurney conveyor roller; stopping rotation of the gurney conveyor roller once the patient is completely on the gurney; stopping rotation of the bed conveyor roller and removing the bed sheet from the bed conveyor roller and the bed; removably attaching a free end of the clean sheet to a roller of a conveyor attached to the bed adjacent an end of the bed positioned furthest from the gurney; rotating the roller of the conveyor attached to the bed adjacent the end of the bed furthest from the gurney moving the patient forward thereto and onto the bed; removing the sheet from the gurney conveyor roller and the roller of the conveyor attached to the bed adjacent the end of the bed furthest away from the gurney; and securing the clean sheet to the bed.

DESCRIPTION OF THE PREFERRED EMBODIMENTS

Figure 1:
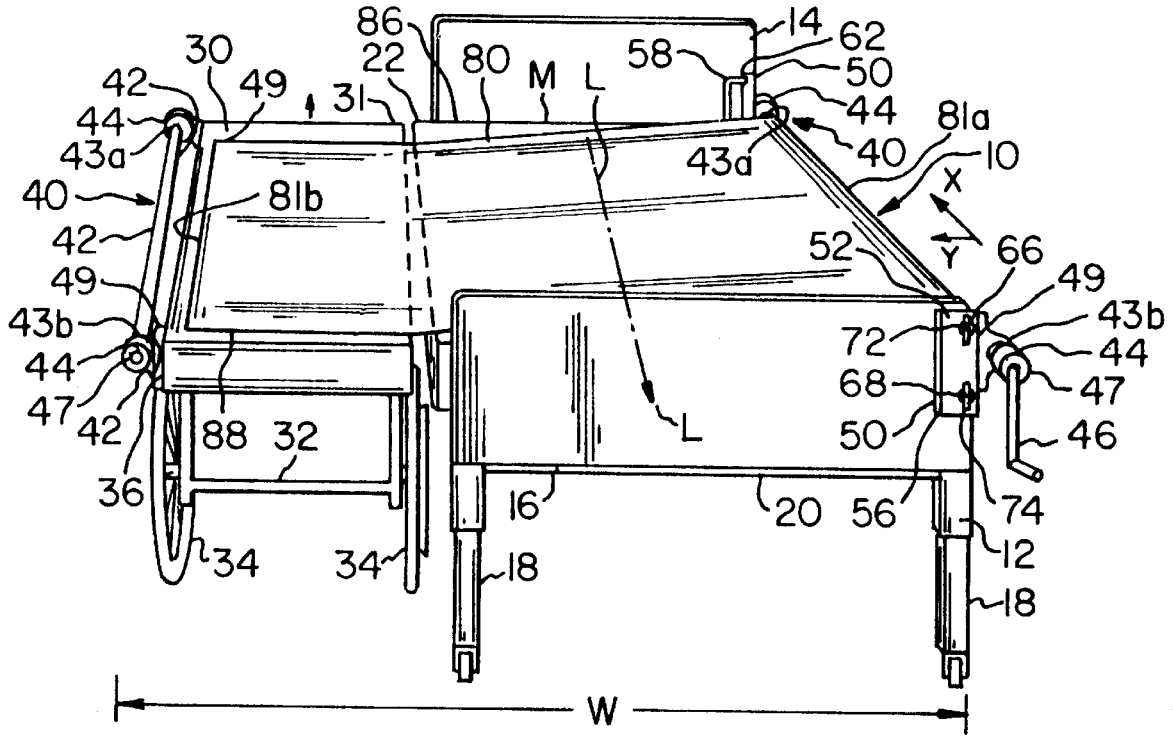
FIG. 1 is a perspective view of a gurney, a hospital bed and a conveyor in accordance with the present invention.
Figure 2:
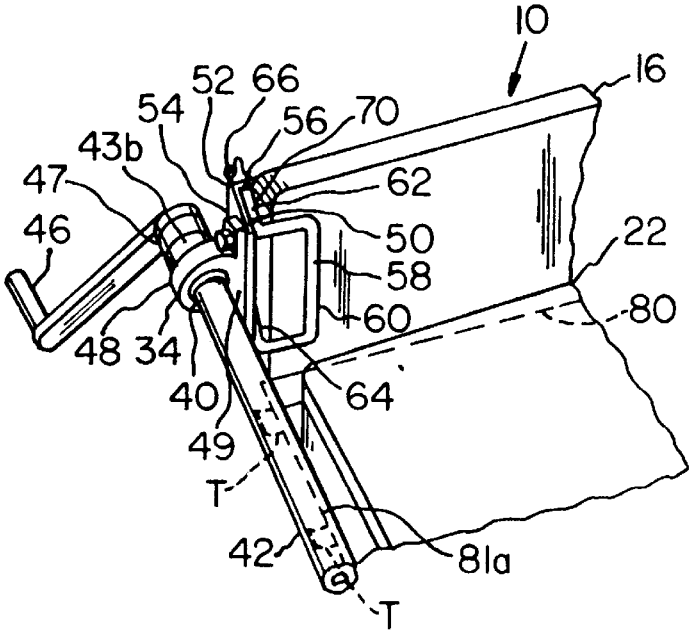
FIG. 2 is a partial top view of a portion of the bed and the conveyor.
Figure 15:
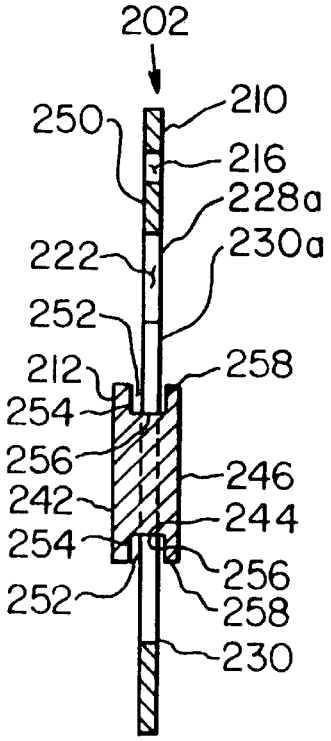
FIG. 15 is a sectional view of the body member and plug member in accordance with the present invention.

Referring to FIGS. 1 and 2, there is shown a bed and a gurney having a conveyor in accordance with the present invention. Specifically, FIG. 1 shows a bed 10 that includes a bed frame or base 12 having a headboard 14, a baseboard 16, legs 18 attached to headboard 14 and baseboard 16 and a mattress supporting frame 20 attached to headboard 14 and baseboard 16 and legs 18. A mattress 22 is supported by mattress supporting frame 20. A gurney 30, which is positioned directly adjacent to a side 31 of mattress 20 of bed 10 includes a frame or base 32 having wheels 34 attached thereto. A patient supporting member 36 is supported by frame 32. Both mattress 20 and patient supporting member 36 extend in a first longitudinal direction shown by the arrow X.

As can be seen in FIG. 1, both bed 10 and gurney 30 have a conveyor 40 attached thereto. Each conveyor 40 includes a roller 42 having two ends or end portions 43*a* and 43*b*. Each end portion 43*a* and 43*b* is rotatably received by or rotatably coupled to a respective bearing unit 44. Thus, bearing units 44 are positioned near opposite ends of roller 42. A removable handle 46 or rotating member is received by a coupling 47 attached to end 43*b* of roller 42. Each bearing unit 44 includes a low friction bearing member, such as the Fafnir R.P.B. bearing and a housing 48. Roller 42, bearing unit 44, handle 46, and coupling 47 are similar to those used in Loadhandler Industries, Inc. LH-1000 Unloader described in U.S. Pat. No. 5,340,266 and PCT Application Ser. No. U.S.94/07816, which are hereby incorporated by reference. Each housing 48 includes an attaching member plate 49. Plate 49 attaches to gurney 30 or bed 10 either by welding plate 49 to gurney frame 32 or bed frame 12, or by fastening plate 49 to gurney frame 32 or bed frame 12, through fasteners, such as screws.

Alternatively, each plate 49 can be attached to or coupled to a conveyor attaching member 50. Each member 50 includes an L-shaped plate 52 having a first leg 54 and a second leg 56 extending therefrom. A second member 58 is provided having a U-shaped portion 60. Two legs 62 and 64 depend from U-shaped portion 60. Preferably, member 58 is formed by bending a metallic rod having a circular cross section. Legs 62 and 64 have threaded ends 66 and 68, respectively. Two holes are defined in leg 56 of L-shaped plate 52 through which legs 62 and 64 pass, respectively. A recess 70 is defined between L-shaped plate 52 and second member 58. Either headboard 14 or baseboard 16 of bed 10 is positioned within recess 70, as shown in FIGS. 1 and 2.

Conveyor 40 attaches to or is coupled bed 10 as follows. First, second leg 56 of L-shaped plate 52 and U-shaped portion 60 of second member 58, which are secured to one of bearing units 44, are pressed against respective sides of headboard 14. Then second leg 56 and U-shaped portion 60 are held in place by wing nuts 72 and 74, which are threadably received by respective threaded ends 66 and 68 of legs 62 and 64 and abut against respective second legs 56. Wing nuts 72 and 74 are tightened sufficiently to hold, through frictional forces, attaching member 50 to headboard 14. The same process is then repeated for second leg 56 and U-shaped portion 60 of the other bearing unit 44, which is secured to baseboard 16, thereby holding conveyor 40 in place.

A sheet 80, such as a bedsheet, is releasably attached to roller 42. Preferably, sheet 80 is at least two times the width W of bed 10 and gurney 30, when bed 10 and gurney 30 are positioned adjacent one another, as shown in FIG. 1. Preferably, an end 81*a* of sheet 80 is releasably attached to roller 42 with adhesive tape T, shown in phantom, such as cloth backed first aid tape or duct tape. Opposite end of sheet 81*b* is unsecured and is a free end. Preferably, sheet 80 is made from high quality fabric, such as cotton or polyester, with at least 180 threads per inch weave construction, although any type of sheeting material which can support a body can be used. We have found that a queen size bed sheet works satisfactory for use with a twin size mattress. Conveyor 40 is adapted to move sheet 80, and in turn a patient 100, in a second longitudinal direction shown by arrow Y, which is transverse to the first longitudinal direction shown by the arrow X.

Moving patient 100 using conveyor 40 is described hereinbelow.

a) Moving a Patient from the Bed to the Gurney

Figure 3:
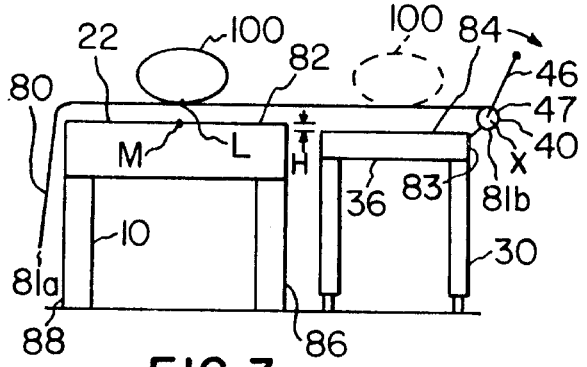
FIG. 3 is a schematic side view of a bed, a gurney, and a conveyor in accordance with the present invention attached to the gurney for moving a patient from the bed to the gurney.

As shown in FIG. 3, initially patient 100 is lying in a prone position on bed 10 preferably on or near longitudinal centerline L of sheet 80. Typically, sheet 80 is secured to bed 10 by tucking sheet 80 under mattress 20. Sheet 80 is then untucked or unsecured from bed 10 and an edge 81*b* of sheet 80 closest to gurney 30 is extended across gurney 30. Conveyor 40 is attached to gurney 30 at a side 83 of gurney 30 furthest from bed 10. Edge 81*b* of sheet 80 is releasably attached to roller 42 using, for example, adhesive tape. Preferably, bed 10 and gurney 30 are adjusted so that an upper surface 82 of mattress 20 is approximately two inches higher H than an upper surface 84 of patient supporting member 36. Height adjusting mechanisms for hospital beds and gurneys are well known in the art. Roller 42 is then slowly rotated about a longitudinal axis X passing through roller 42, so that preferably at least two complete wraps of sheet 80 are wound onto roller 42. Handle 46 is then inserted into or attached to coupling 47 of conveyor 40. Roller 42 is then rotated about longitudinal axis X, so that sheet 80 continues to be wound onto roller 42. This causes sheet 80 with patient 100 lying on an upper surface thereof to be slide across upper surface 82 of mattress 10 and upper surface 84 of gurney supporting member 36, thereby, causing patient 100 to be moved from bed 10 to gurney 30, as shown in phantom in FIG. 3. Any remaining part of sheet 80 on bed 10 after patient 100 is transferred to gurney 30 can be placed over patient 100. Patient 100 can then be transported by gurney 30.

b) Moving a Patient from the Gurney to the Bed

Figure 4:
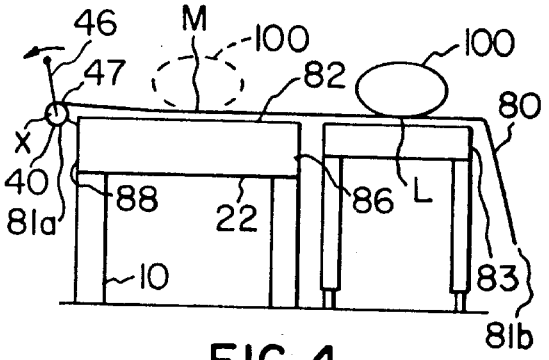
FIG. 4 is a schematic view of a bed, gurney and a conveyor in accordance with the present invention attached to the bed for moving a patient from the gurney to the bed.
Figure 5:
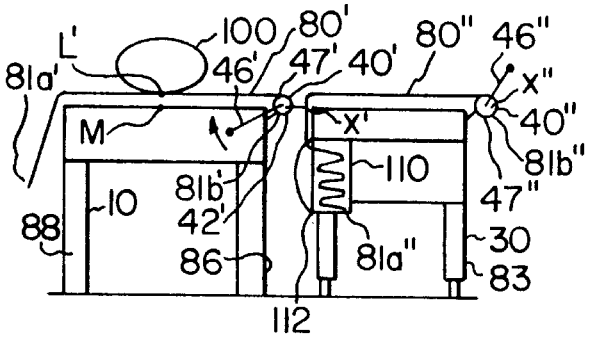
FIGS. 5–9 are schematic views showing a bed, a gurney and a conveyor in accordance with the present invention, for moving a patient to and from the bed and the gurney for the purposes of changing a bed sheet on the bed.
Figure 6:
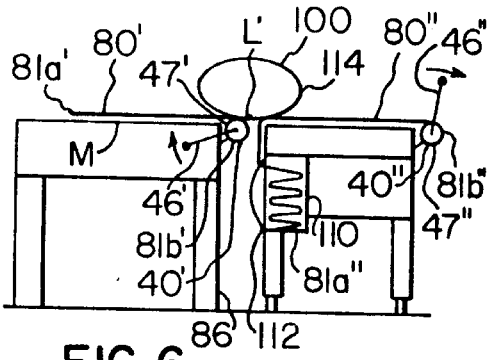
Figure 7:
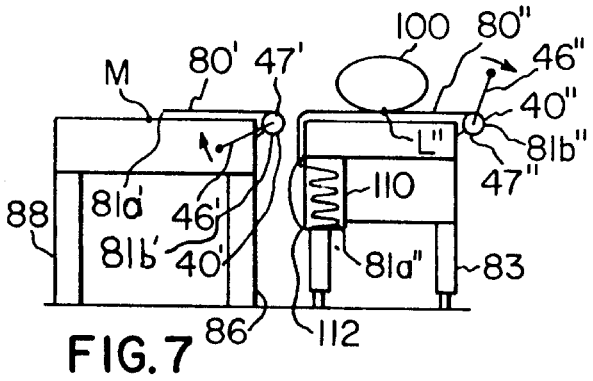

As shown in FIG. 4, initially patient 100 is lying in a prone position on gurney 30. Specifically, patient is lying on or near longitudinal centerline L of sheet 80 resting on upper surface 84 of patient supporting member 36. Gurney 30 is positioned along a side 86 of bed 10. Conveyor 40 is attached to bed 10 on side 88 of bed 10 furthest from gurney 30. Edge 81*a* of sheet 80 closest to bed 10 is removably attached to roller 42 with, for example, four or five short pieces of adhesive tape as previously described. Preferably, bed 10 and gurney 30 are adjusted so that upper surface 82 of mattress 20 is approximately two inches above upper surface 84 of patient supporting member 36. Roller 42 is then slowly rotated about longitudinal axis X so that preferably at least two complete wraps of sheet 80 are wound onto roller 42. Handle 46 is then inserted into or attached to coupling 47 of conveyor 40 and roller 42 is rotated about the longitudinal axis X so that sheet 80 continues to be wound onto roller 42. This causes patient 100 to be moved from gurney 30 onto bed 10 in a manner similar to moving patient 100 from bed to gurney 30. Roller 42 is rotated until the patient is located in a middle section M of bed 10. Sheet 80 is then removed from roller 42 by removing the adhesive tape and can be secured to bed 10 by tucking sheet 80 under mattress 20. Conveyor 40 may then be removed from bed 10.

c) Changing Sheets on a Bed of a Prone, Immobile Patient Without Lifting or Manipulating the Patient FIGS. 5–9 show a method for changing sheets on bed 10 of a prone, immobile patient without lifting or manipulating the patient. At least two conveyors 40 are required and are designated 40' and 40". A first conveyor 40' attaches to side 86 of bed 10 and a second conveyor 40" attaches to side 83 of gurney 30 as shown in FIG. 5. Conveyors 40' and 40" are the same as conveyor 40 previously described. Initially, patient 100 is on bed sheet 80 on bed 10, lying essentially on longitudinal centerline L' on sheet 80'. Sheet 80', which is positioned under patient 100, is unsecured or untucked and removably attached at longitudinal edge 81*b*' with adhesive tape, or another type of removable fastener, to roller 42'. Then, roller 42' is turned slowly by hand so that preferably at least two wraps of sheet 80' are wound around roller 42'. A fresh sheet 80" is then laid across patient supporting member 36 of gurney 30. Longitudinal edge 81*b*' of sheet 80" is attached with adhesive tape to roller 42". Then, roller 42" is turned slowly by hand so that preferably at least two wraps of sheet 80" are wound around roller 42". Loose end 81*a*" of fresh sheet 80" is gathered and folded concertina style and laid in a sheet retaining receptacle 110, as shown in FIGS. 5 through 9, positioned underneath a longitudinal edge 112 of gurney 30. Edge 112 of gurney 30 is positioned adjacent side 86 of bed 10 and conveyor 40' so that conveyor 40' is positioned between bed 10 and gurney 30, and conveyor 40" of gurney 30 is positioned on the side of gurney 30 furthest from bed 10. Preferably, bed 10 and gurney 30 are adjusted so that upper surface 82 of mattress 20 is about two inches above upper surface 84 of patient supporting member 36 and an upper horizontal tangent of roller 42' should be approximately one inch below surface 82. Preferably, gurney 30 is then clamped to bed 10 using any sort of clamping device, for example, a C-clamp, although locking the wheels of gurney 30 will also suffice. Handle 46' is then inserted into or attached to coupling 47' of conveyor 40' and turned, moving patient 100 toward gurney 30, until a shoulder of patient 100 is positioned over gurney 30 and starts to push fresh sheet 80" across gurney 30 toward side 83, as shown in FIG. 6. Second handle 46" is then inserted into or attached to coupling 47" of conveyor 40". Handle 46" should then be rotated about a longitudinal axis X" moving fresh sheet and patient 100 onto gurney 30, as shown in FIG. 7. Preferably, handle 46' should continue to be rotated while handle 46" is rotated.

Figure 8:
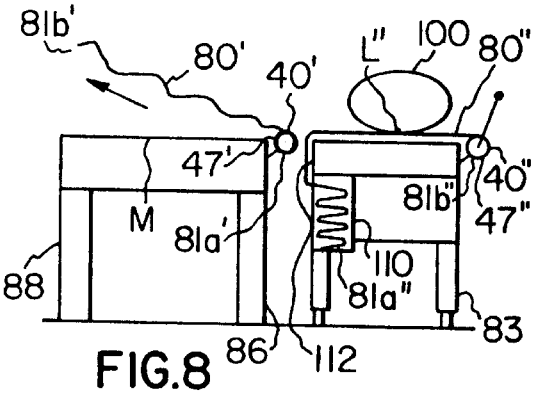
Figure 9:
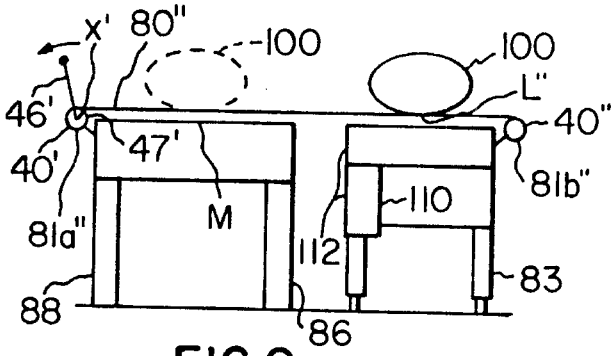

Once patient 100 is on gurney 30, rotation of handles 46' and 46" is stopped and sheet 80" is removed from bed 10 and conveyor 40' by grasping free edge 81*b*' of sheet 80' lying on bed 10 and pulling it off roller 42", as shown in FIG. 8. Conveyor 40' is then moved and attached to side 88 of bed 10, i.e., to the side furthest away from gurney 30, as shown in FIG. 9. Free edge 81*a*" of sheet 80" is extended across mattress 20 of bed 10 and removably attached to roller 42'. Handle 46' is then attached or inserted into coupling 47' of conveyor 40' and rotated about the longitudinal axis X', as previously discussed, thereby wrapping sheet 80" around roller 42". Patient 100 is then moved by sheet 80", which is moved by conveyor 40', from gurney 30 onto bed 10 and is now lying on fresh sheet 80". Sheet 80" is then removed from rollers 42' and 42" and can be tucked under mattress 20 in an appropriate fashion. Sheet 80" can also be removed from roller 42" prior to its being wound around roller 42'. Conveyors 40' and 40" may then be removed from bed 10 and/or gurney 30.

It should be noted that conveyor 40 can include a motor in lieu of a handle to rotate roller 42. Further, conveyor 40 described above can be permanently affixed to bed 10 or gurney and one or two conveyors may be attached to bed 10 and/or gurney 30. This depends on whether a conveyor is attached to one side or both sides of bed 10 or gurney 30.

Conveyor 40 and the above-described methods for moving a patient from gurney 30 to bed 10 solve several problems in moving immobile patients. First, conveyor 40 is inexpensive to manufacture and simple to operate, and overcomes many of the problems involved in the complex conveying mechanisms presently known in the art. Further, conveyor 40 utilizes a bed sheet 80 which is then used on the bed. This eliminates the need to move the patient by lifting the patient from gurney 30 to bed 10 or vice versa. Further, the patient need not be physically lifted by a nurse's aid or nurse because the patient is transported by the sheet. This will minimize injuries to nurses, nurse's aides and patients in moving a patient from gurney 30 to bed 10 or vice versa. Furthermore, only one person is required to move the patient between gurney 30 and bed 10. This will result in a substantial labor cost savings associated with transferring patients.

A second embodiment of conveyor 40, identified as conveyor 200, is shown in FIGS. 10 to 20. Conveyor 200 is similar to conveyor 40 except conveyor 200 includes a clip 202. Like reference numerals are used for like parts.

Figure 10:
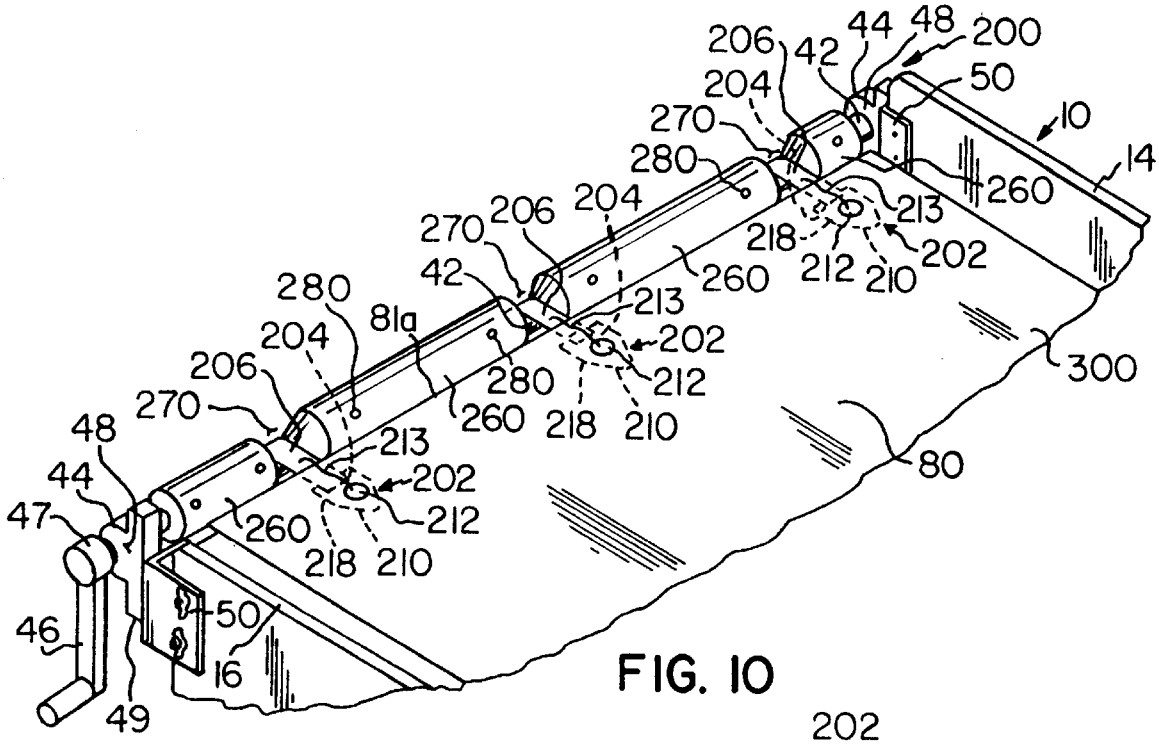
FIG. 10 shows a partial perspective view of a bed and a conveyor having a belt and a clip in accordance with the present invention.

As shown in FIG. 10, conveyor 200 includes a roller 42, bearing units 44, and a removable handle 46 received by a coupling 47. Each bearing unit includes a low friction bearing and housing 48, which includes an attaching member plate 49. Each plate 49 can be attached to a conveyor attaching member 50.

Three fasteners or clips 202 are attached to roller 42. Specifically, each clip 202 is attached to an end 204 of a respective flexible belt 206. An opposite end 208 of belt 206 is attached to roller 42. Preferably, three or four belts 206 are spaced along roller 42. Preferably, belts 206 are permanently attached to roller 42, either by an adhesive or by mechanical fasteners. Belts 206 are made of a flexible material such as woven polypropylene, woven polyethylene or cotton. Preferably, belts 206 should be at least as long as the sheet being replaced, say three to four feet for a twin sized bed.

As shown in FIGS. 10–16, each clip 202 includes a substantially flat body member 210 and a plug member 212. Preferably, plug member 212 is attached to belt 206 by a flexible string 213 to prevent plug member 212 from being misplaced (See FIG. 10). Body member 210 includes a first section 214 defining a belt receiving slot 216. Belt end 204 passes through slot 216 and is sewn to a section 218 of belt 206 to attach clip body member 210 to belt 206 (See FIG. 16). Alternatively, Velcro® type fasteners can be provided on belt end 208 and belt section 218 so they can be releasably secured to each other. Using the Velcro® type fastener permits adjustment of the length of belt 206.

Figure 12:
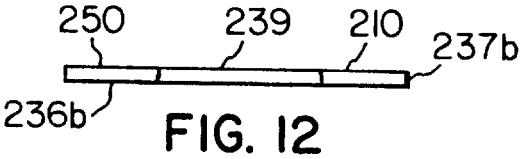
FIG. 12 is a front view of the clip body member shown in FIG. 11.
Figure 11:
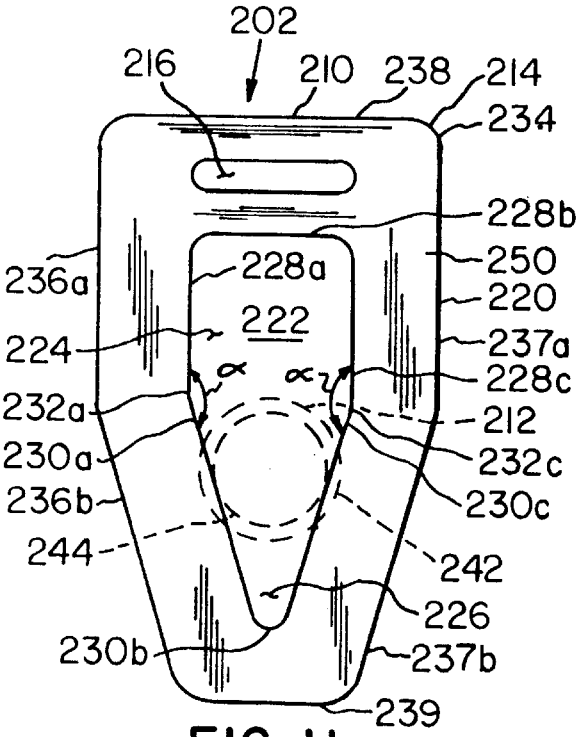
FIG. 11 is a top view of a clip body member in accordance with the present invention.
Figure 16:
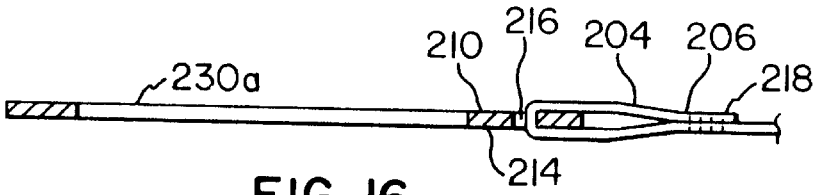
FIG. 16 is a sectional view of the body member and a belt in accordance with the present invention.
Figure 17:
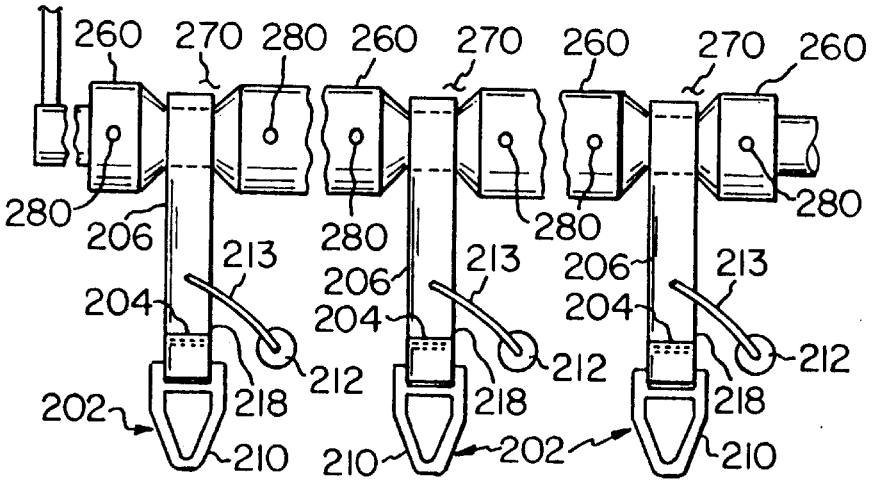
FIG. 17 is a top view of a portion of the conveyor shown in FIG. 10.
Figure 18:
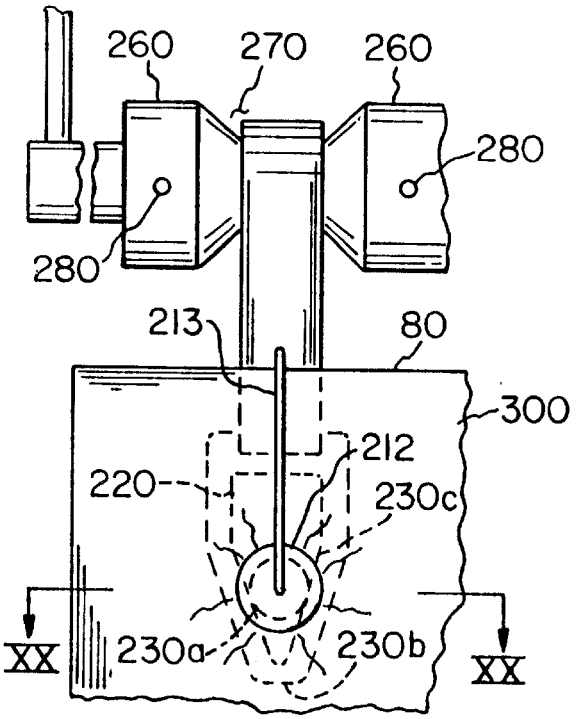
FIG. 18 is a top view of a portion of the conveyor shown in FIG. 10 with a sheet attached thereto.
Figure 19:
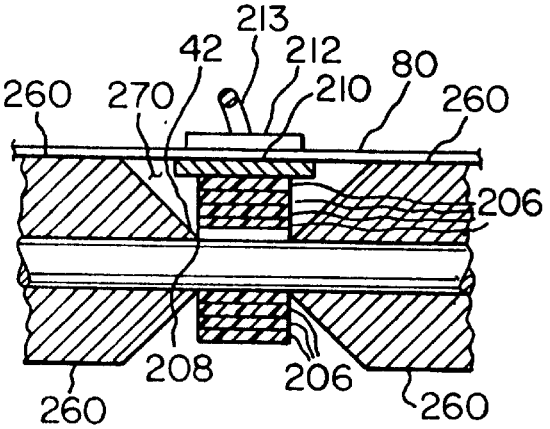
FIG. 19 is a partial sectional view of the conveyor shown in FIG. 10 with the belt partially wrapped around the conveyor.
Figure 20:
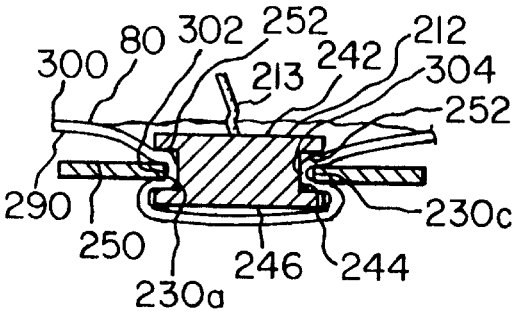
FIG. 20 is a section taken along line XX—XX of FIG. 18.

As shown in FIGS. 11 and 12, body member 210 includes a second section 220 defining a plug member receiving slot 222. Slot 222 includes a rectangular shaped section 224 and a converging or triangular shaped section 226. Rectangular shaped section 224 is defined by three edges 228*a*, 228*b* and 228*c*. Edges 228*a* and 228*c* have a length $A_1$ and edge 228*b* has a length $A_2$. Triangular shaped section 226 includes three edges 230*a*, 230*b* and 230*c*. Edges 230*a* and 230*c*intersect edges 228*a* and 228*c* at intersection points 232*a* and 232*c* wherein edges 228*a* and 228*c* and edges 230*a* and 230*c* are spaced apart a distance $A_2$", which in this case is equal to $A_2$. Edge 230*b* has a length $A_3$. Edges 230*a* and 230*c* converge toward edge 230*b*. An angle $\alpha$ is defined by edges 230*a*, 230*c* and 228*a*, 228*c*, respectively, at points 232*a* and 232*c*. Body member 210 has an outer edge 234 including first sides 236*a*, 236*b*; second sides 237*a*, 237*b*; first end 238 and second end 239 having lengths $A_4$, $A_5$, $A_6$, $A_7$, $A_8$ and $A_9$, respectively. Preferably, body member 210 is made from high density polyethylene, ultra high molecular weight polyethylene, such as Solidor® by Phillips Petroleum, polypropylene or polyolefin, which is flexible and yet sufficiently strong so as not to fail when used.

Body member 210 can be fabricated or molded. An actual body member has been fabricated wherein length $A_1$ is 1.25 inches, length $A_2$ is 1.5 inches, length $A_3$ is 0.5 inch and angle $\alpha$ is 165°. Body member 212 was made of high density polyethylene having a thickness of 0.125 inch. Lengths $A_4$–$A_9$ are approximately 2.25 inches, 2.5 inches, 2.25 inches, 2.5 inches, 3 inches and 1.5 inches. Slot 216 has dimensions of approximately 1.5 inches and 0.25 inches wide.

Figure 14:
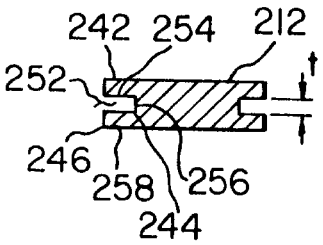
FIG. 14 is a section taken along line XIV—XIV of FIG. 13.
Figure 13:
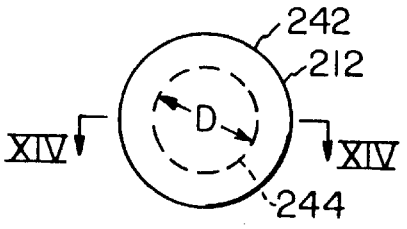
FIG. 13 is a top view of a clip plug member in accordance with the present invention.

As shown in FIGS. 13 and 14, plug member 212 includes three circular shaped discs or members 242, 244 and 246, wherein disc 244 is sandwiched between and secured to discs 244 and 246. Disc 244 has a geometric diameter D, which is less than the diameter of discs 242 and 246. The diameter of disc 244 is less than $A_2$", but greater than length $A_3$. Preferably, discs 242 and 246 have the same diameter, which is less than or equal to $A_1$, or $A_2$, so that plug 212 can pass through rectangular shaped section 224. Alternatively, disc 242 can have a diameter greater than length $A_2$ and rests on an upper surface 250 of body member 212, so that discs 244 and 246 can pass only through section 224. The thickness "t" of disc 244, and in turn, the spacing between discs 242 and 246 preferably are the same or slightly greater than the thickness of body member 212 (See FIG. 15). A body member receiving recess 252 is defined by surfaces 254, 256 and 258 of discs 242, 244 and 246, respectively. Preferably, plug 240 should be made of rubber and molded in one piece, such as EPDM rubber, having a Shore hardness on the A scale of 60–70.

An actual plug 240 has been made wherein discs 242 and 246 each have a diameter of 1.5 inches and disc 244 has a diameter of 0.75 inch and a thickness of 0.125 inch.

Conveyor 200 also includes a plurality of sleeves 260 secured to roller 42, as shown in FIGS. 10 and 17–19. Sleeves 260 are substantially hollow cylindrical members that slide over roller 42 and are positioned apart a distance slightly greater than the width of belts 206, so as to define a belt receiving recess 270 (See FIGS. 17–19). Sleeves 260 are attached to roller 42 by set screws 280. By use of belts 206 of sufficient length, say 3–4 feet, a standard size bed sheet can be used in lieu of an oversized bed sheet as previously discussed, i.e., a twin size standard bed sheet for a twin sized bed mattress as opposed to a queen size bed sheet for a twin sized bed mattress.

The above described methods for transferring a patient are the same when using either the clip 202 or tape T, except that rather than taping sheet 80, 80' or 80" to roller 42, sheet 80, 80' or 80" is clipped to roller 42 as explained below. First, in the case of moving a patient from bed 10 to gurney 30, sheet 80, for example, is untucked. Each belt 206 is extended so that an underside 290 of sheet 80 rests on upper surface 250 of body member 210 (See FIGS. 10, 18 and 20). Plug member 212 is then placed on an upper surface 300 of sheet 80 directly over rectangular section recess 220. Each respective plug member 212 is then pressed against sheet 80 and moved towards edge 230*b* until edges 230*a* and 230*c* are received in recess 252. Plug member 212 is further moved towards end 230*b* until sheet 80 is bound and sandwiched between discs 242, 244, 246 and portions of edges 230*a*, 230*c* at interfaces 302 and 304 so that plug member 212 coacts with portions of edges 230*a* and 230*b* to releasably attach sheet 80 to conveyor 40 (See FIG. 20).

Roller 42 is then rotated as previously discussed. Belts 206 are wound on roller 42 and are received in respective recesses 270 with sleeves 260 acting as guides for belts 206. This in turn causes sheet 80 to be pulled toward roller 42 by clips 202 and belts 206. Continued rotation of roller 42 forces each plug member 212 to move towards a respective edge 230*b*, thereby firmly securing sheet 80 to the respective clip 202. Continued rotation of roller 42 causes belts 206 and clips 202 to be wound onto roller 42. Preferably, clips 202 are flexible enough to wrap around roller 42. Continued rotation of roller 42 causes sheet 80 to wrap around roller 42 (See FIG. 19). This causes patient 100 to be moved by sheet 80 from bed 10 to gurney 30 as previously discussed. To remove sheet 80 from roller 42, roller 42 is unwound until clips 202 are exposed. Each plug member 212 is moved towards the respective edge 228*b*, so that plug member 212 unbinds sheet 80. Each plug member 212 is removed from slot 222 and away from sheet 80, so that each clip 202 disengages from sheet 80. Hence, clips 202 releasably attach sheet 80 to conveyor 40. Clip 202 can be used in lieu of tape T for any of the described methods.

Clip 202 can also be used for securing other sheet material or membranes, such as boat covers, car covers, flexible covers or tarpaulins.

Having described the presently preferred embodiments of our invention, it is to be understood that it may be otherwise embodied within the scope of the following claims.

I claim:

1. A method for changing a sheet on a bed of an immobile patient, using a bed and a gurney, the bed including a mattress having a sheet secured thereto and the gurney including a patient supporting surface, each of the bed and the gurney including a conveyor comprising:

A) a roller having a first end and a second end;

B) an attaching member for attaching the roller to the frame, the roller rotatably secured to the attaching member; and C) a rotating member secured to the roller for rotating the roller about an axis passing through the roller, said method comprising the steps of:

a) placing the patient on the sheet on the mattress;

b) unsecuring the sheet from the bed;

c) attaching an end of the sheet to the roller attached to the bed;

d) moving the gurney so that a side of the gurney is adjacent the conveyor roller attached to the bed, wherein the conveyor roller attached to the gurney is positioned on an opposite side of the gurney and away from the conveyor roller attached to the bed;

e) attaching an end of a clean sheet to the conveyor roller attached to the gurney;

f) extending the clean sheet over the patient supporting surface of the gurney;

g) rotating the bed conveyor roller so as to move the patient toward the bed conveyor roller;

h) rotating the gurney conveyor roller when the patient contacts the gurney, moving the patient toward the gurney conveyor roller;

j) stopping rotation of the gurney conveyor roller once the patient is completely on the gurney;

k) stopping rotation of the bed conveyor roller and removing the bed sheet from the bed conveyor roller and the bed;

l) removably attaching a free end of the clean sheet to a roller of a conveyor attached to the bed adjacent an end of the bed positioned furthest from the gurney;

m) rotating the roller of the conveyor attached to the bed adjacent the end furthest from the gurney moving the patient toward thereto and onto the bed;

n) removing the sheet from the gurney conveyor roller and the bed conveyor roller attached to the bed adjacent the end furthest away from the gurney; and o) securing the clean sheet to the bed.

2. An apparatus for transporting a patient comprising:

a) a base;

b) a patient supporting member attached to said base;

c) a conveyor attached to said base, wherein said conveyor comprises:

i) a roller having a length substantially equal to a length of said base, said roller having a first end and a second end;

ii) an attaching member coupled to said roller and coupled to said base, wherein said attaching member comprises an adjustable bracket comprising a first L shaped member having a first leg and second leg, said first leg coupled to said roller and said second leg extending from said first leg, said second leg having two spaced apart holes, a second member having a U-shaped portion with two legs extending therefrom, a portion of each of said legs being threaded, said threaded portions of each of said legs passing through a respective one of said holes, and threaded nuts received by said respective threaded portions of said legs and abut against said second leg, wherein a recess is defined by said first L-shaped member and said second member which receives a portion of said base, whereby when the nuts are tightened against said second leg said conveyor is held in place to said base by frictional forces between said first L-shaped member, said second member and said base; and iii) a handle attached to said roller for rotating said roller about a longitudinal axis passing through said roller; and d) a removable sheet adapted to be positioned onto said patient supporting member, said sheet having a first end and a second end, wherein said sheet is flexible having an underside adapted to slide along a surface of the patient supporting member, said sheet first end removably attached to said roller and said sheet second end being free, whereby a patient positioned on said sheet extended across said patient supporting member can be moved toward said roller when said roller is rotated, rotation of said roller causing said sheet to be wound onto said roller.

3. An apparatus for transporting a patient as claimed in claim 2, further comprising a bearing unit attached to said L-shaped member and rotatably coupled to said first end of said roller.

4. A method for transporting a patient initially positioned on a sheet of a bed having a mattress to be transported onto a gurney having a patient supporting member by a conveyor, the conveyor including:

A) a roller having a length substantially equal to a length of the bed and the gurney, the roller having a first end and a second end;

B) an attaching member for attaching the roller to the one of the bed and the gurney, the roller rotatably secured to the attaching member; and C) a rotating member attached to the roller for rotating the roller about an axis passing through the roller, said method comprising the following steps:

a) unsecuring the sheet from the bed;

b) attaching the conveyor to the gurney;

c) positioning the gurney adjacent to the bed so that the conveyor is positioned along a side of the gurney, the side being furthest away from the bed;

d) adjusting the bed and the gurney so that an upper surface of the bed mattress is positioned above an upper surface of the patient supporting surface of the gurney;

e) extending the sheet over the gurney;

f) removably attaching the sheet to the roller;

g) rotating the roller and thereby winding the sheet around the roller;

h) moving the patient on the sheet from the bed toward the roller onto the gurney; and i) removing the sheet from the roller after the patient is moved.

5. A method for transporting a patient from a gurney having a patient supporting member to a bed having a mattress, wherein a conveyor is attached to the bed and wherein a sheet is positioned on the patient supporting surface of the gurney and the patient is initially positioned on the gurney on a lateral centerline of the sheet, the conveyor including:

A) a roller having a length substantially equal to a length of the bed and the gurney, the roller having a first end and a second end;

B) an attaching member for attaching the roller to the one of the bed and the gurney, the roller rotatably secured to the attaching member; and C) a rotating member attached to the roller for rotating the roller about an axis passing through the roller, said method comprising the following steps:

a) attaching the conveyor to the bed;

b) positioning the gurney adjacent to the bed so that the conveyor is positioned along a side of the bed, the side being furthest away from the gurney;

c) extending a portion of the sheet across the bed after the gurney is positioned adjacent the bed;

d) removably attaching an edge of the sheet to the roller;

e) adjusting the bed and the gurney so that an upper surface of the bed mattress is positioned above an upper surface of the patient supporting member of the gurney;

f) rotating the roller and thereby winding the sheet around the roller;

g) moving the patient onto the bed until the longitudinal centerline of the sheet corresponds to a centerline of the bed mattress; and h) removing the sheet from the roller and securing the sheet to the bed.

* * * * *

UNITED STATES PATENT AND TRADEMARK OFFICE

CERTIFICATE OF CORRECTION

PATENT NO. : 5,819,339

DATED : October 13, 1998

INVENTOR(S) : Graham L. Hodgetts

It is certified that error appears in the above-identified patent and that said Letters Patent is hereby corrected as shown below:

Column 1 Line 22 "laying" should read --lying--.

Column 2 Line 52 "having" should read --have--.

Column 3 Line 32 "from roller" should read --from the roller--.

Column 5 Line 20 between "coupled" and "bed" insert --to--.

Column 5 Line 46 "satisfactory" should read --satisfactorily--.

Column 6 Line 7 "to be slide" should read --to be slid--.

Column 6 Line 9 after "thereby" delete comma --,--.

Column 7 Line 23 "roller 42'''" should read --roller 42'--.

Column 7 Line 31 "roller 42'''" should read --roller 42'--.

Column 7 Line 42 after "gurney" insert --30--.

Column 7 Line 54 "nurse's aid" should read --nurse's aide--.

Column 8 Line 34 between "230c" and "intersect" insert a space.

Column 8 Line 37 "$A_2$'''" should read --$A_2$'--.

Column 8 Line 63 "$A_2$'''" should read --A'--.

Column 8 Line 65 after "$A_1$" delete comma --,--.

UNITED STATES PATENT AND TRADEMARK OFFICE

CERTIFICATE OF CORRECTION

PATENT NO. : 5,819,339

DATED : October 13, 1998

INVENTOR(S) : Graham L. Hodgetts

It is certified that error appears in the above-identified patent and that said Letters Patent is hereby corrected as shown below:

Claim 2 Column 10 Lines 61-62 "L shaped member" should read --L-shaped member--.

Signed and Sealed this

Eleventh Day of May, 1999

*Attest:*

*Attesting Officer*

Q. TODD DICKINSON

*Acting Commissioner of Patents and Trademarks*